US006047669A

United States Patent [19]

Lüke et al.

[11] Patent Number: 6,047,669

[45] Date of Patent: Apr. 11, 2000

[54] ENGINE ROTATION REVERSAL MECHANISM

[75] Inventors: Peter Lüke, Bensheim; Rolf Coester, Nümbrecht, both of Germany

[73] Assignee: Motorem-Werke Mannheim AG, Mannheim, Germany

[21] Appl. No.: 09/207,164

[22] Filed: Dec. 7, 1998

[30] Foreign Application Priority Data

Nov. 17, 1998 [DE] Germany ..... 197 55 618

[51] Int. Cl.[7] ..... F01L 1/00

[52] U.S. Cl. ..... 123/41 R; 123/90.31; 123/DIG. 6

[58] Field of Search ..... 123/41 R, 90.31, 123/DIG. 6, DIG. 7

[56] References Cited

U.S. PATENT DOCUMENTS

| | | | |
|---|---|---|---|
| 858,281 | 6/1907 | Hansen | 123/41 R |
| 914,366 | 3/1909 | Willet | 123/41 R |
| 929,796 | 8/1909 | Smith | 123/41 R |
| 1,239,029 | 9/1917 | Moraski | 123/41 R |
| 1,250,224 | 12/1917 | Remmen | 123/41 R |
| 3,732,745 | 5/1973 | Jackson | 74/325 |
| 4,671,223 | 6/1987 | Asano et al. | 123/90.31 |
| 5,111,782 | 5/1992 | Mezger | 123/90.31 |
| 5,272,937 | 12/1993 | Brosowske et al. | 74/573 R |

FOREIGN PATENT DOCUMENTS 1 300 340 3/1964 Germany .

*Primary Examiner*—Noah P. Kamen
*Assistant Examiner*—Hai Huynh
*Attorney, Agent, or Firm*—Charles L. Schwab; Hardway/Mann IP Group

[57] ABSTRACT

To facilitate construction of internal combustion engines rotating in opposite directions using the same crankcase, three recessed bearings 5, 5*a*, 5*b*, are formed in the crankcase. For engines operating in a first direction of rotation, a first bearing 5 supports a first intermediate gear 4 to provide the driving connection between the crankshaft 2 and the camshaft 7, and for an engine having an opposite direction of rotation the second and third bearings 5*a*, 5*b*, support a second intermediate gear 4 and the first intermediate gear 8 to provide the driving connection between the crankshaft 2 and the camshaft 7. This construction permits a simple conversion operation to change the rotation direction of the internal combustion engine.

4 Claims, 4 Drawing Sheets

ENGINE ROTATION REVERSAL MECHANISM

TECHNICAL FIELD

This invention relates to an internal combustion engine having a crankcase rotatably supporting a crankshaft and presenting a cylinder in which a piston is reciprocated by a connecting rod interconnecting the piston and crankshaft. The cylinder is covered by a cylinder head so as to form a working space and the working space is connected to breathing ducts via breathing valves. The breathing valves are normally actuated by a camshaft driven by valve-actuating gearing which may include mechanism for changing the rotation direction of the internal combustion engine.

BACKGROUND OF THE INVENTION

The internal combustion engine shown and described in German patent document 1,300,340 shows mechanism for effecting the change in rotation direction of the internal combustion engine by use of a displaceable camshaft. For this purpose the camshaft has opposed cams for the actuation of the breathing valves in both rotation directions. An expensive control device is required for the change in rotation direction of the internal combustion engine; and additionally, all auxiliary mechanisms must be designed for both rotation directions. Such an internal combustion engine represents a compromise with respect to its optimization for performance, because the present-day requirements in this respect can only be partly satisfied.

OBJECTS AND SUM AY OF THE INVENTION

It is an object of the invention to provide an internal combustion engine in which the internal combustion engine has fully optimized performance for both rotation directions.

This object is achieved by providing in the crankcase or a gearbox, a mechanism having three recessed bearings, of which, in the first rotation direction, a first bearing supports a first intermediate gear for the rotational connection of the crankshaft and the camshaft, and for an engine having a second (opposite) rotation direction, a second and a third bearing each support an intermediate gear for the driving connection between the crankshaft and the camshaft. It is true that this device necessitates minor modifications in order to change the rotation direction of the internal combustion engine; however, only a few additional parts are needed. In the assembly of the internal combustion engine, one or two intermediate gears are inserted between the crankshaft and the camshaft, depending on the desired rotation direction, so that the rotation direction of the crankshaft changes while the rotation of the camshaft remains the same. By this construction, no modifications at all need be made to the valve drive and, in particular, to the camshaft of the internal combustion engine, and with regard to the auxiliary mechanisms driven by the crankshaft, care need only be taken that these are either appropriately designed for driving by the crankshaft or replaced by appropriately adapted auxiliary mechanisms. This holds true, for example, for a lubricating-oil pump that is driven by the crankshaft and for hydraulic pumps driven by the crankshaft. Auxiliary mechanisms driven by the camshaft can remain unchanged. In particular, however, the camshaft can be optimized for one rotation direction, and no compromises need be made in its design. During the manufacture of the internal combustion engine, the bearings for the intermediate gears are recessed directly into the crankcase or, for example, a gearbox attached to the crankcase. With regard to the manufacturing process, this represents only a very slight additional expense, which has scarcely any significance in terms of costs.

The achieved advantages are the universal application of this internal combustion engine; that is, for example, a right-handed-rotating internal combustion engine can be converted and, if necessary, even retroconverted to a left-handed-rotating internal combustion engine. What is more, inventory is reduced because of the design of the crankcase, or gearbox, which otherwise must be manufactured differently.

In making use of the invention, the first intermediate gear for the reversal of direction can be repositioned to one of the second and third bearings, and a second intermediate gear can be supported by the other one of the second and third bearings in order to establish the rotational connection between crankshaft and camshaft for engines rotating in two directions. By this construction it is possible to use identical parts in both rotation-direction versions, and the only additional part needed is a further intermediate gear (with the requisite bearing apparatus). By this construction the parts inventory is reduced to the minimum possible.

Preferably the toothing of the gears is a step-up toothing. This has proved especially suitable for the forces to be transmitted, in particular from the standpoint of noise. The toothing is designed as straight. If necessary, a damper can be provided in order to suppress vibration, particularly in the camshaft gear. This damper is provided in particular in multicylinder internal combustion engines, for example 18 or 20 cylinder internal combustion engines.

The internal combustion engine incorporating this invention can be of in-line or V design. In the case of a V design, two camshafts are then provided, one device for reversal of rotation direction being provided for each camshaft. If an appropriate series of internal combustion engines is manufactured in both in-line and V versions, the same parts can be used for the gear drive in both versions. The camshafts in the V-type internal combustion engine rotate in opposite directions. As a consequence, the same design camshaft can be installed in both sides of the internal combustion engine, said camshaft having mounting stubs on both ends of the shaft for a camshaft gear.

BRIEF DESCRIPTION OF THE DRAWINGS

Further advantageous aspects of the invention can be inferred from the description of the drawings, in which.

DETAILED DESCRIPTION OF THE INVENTION

Figure 1:
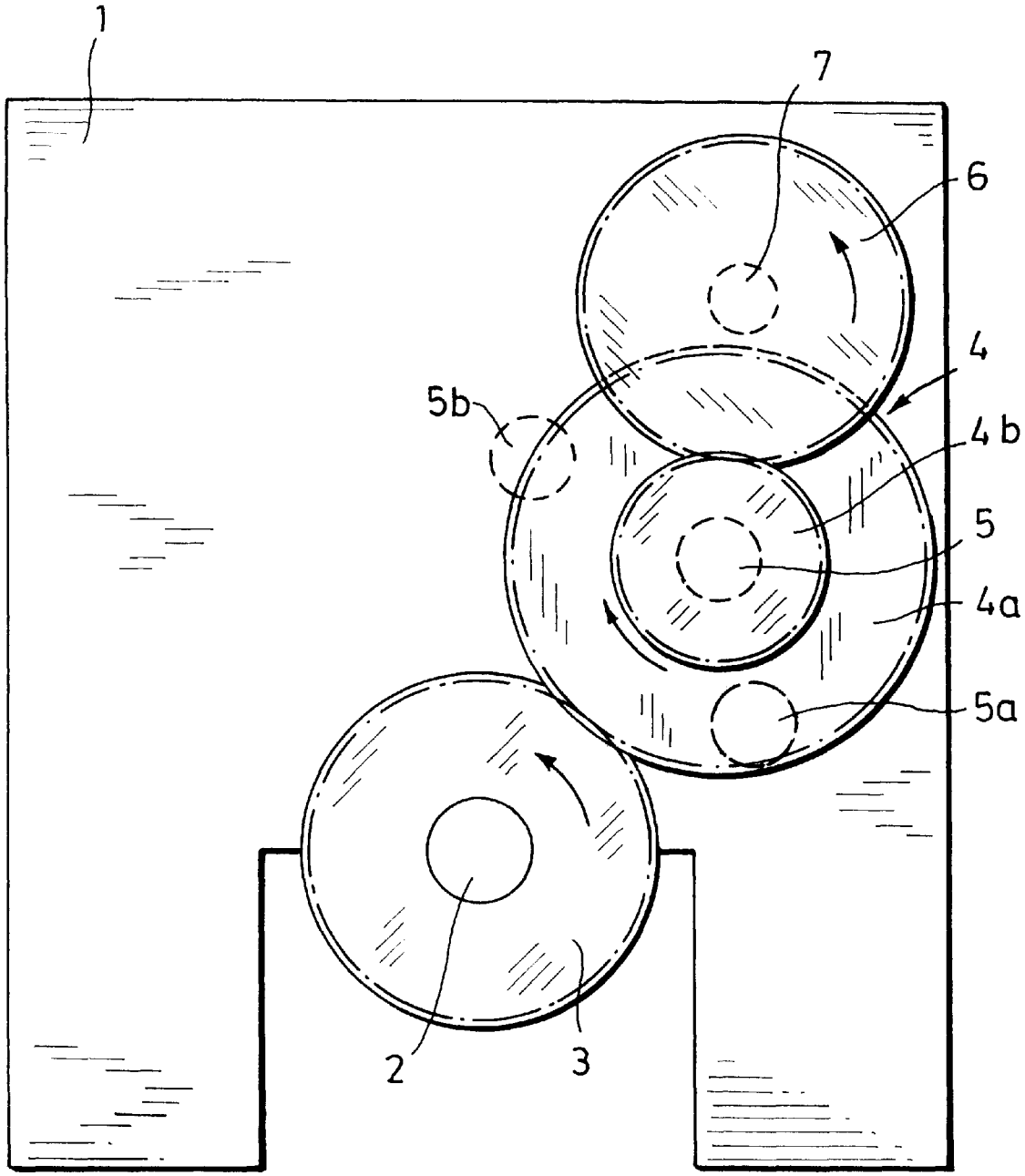
FIG. 1 shows a left-handed-rotating internal combustion engine of in-line design.

In the internal combustion engine of FIG. 1, the crankcase 1 is shown schematically, includes cylinders (possibly with the interposition of an intermediate case), and cylinder heads and other standard assemblies are mounted thereon. In the lower part of the crankcase 1, a crankshaft 2 is rotatably supported, a crankshaft gear 3 being attached to the crankshaft 2 so as to rotate therewith to the left (counterclockwise) as indicated by the arrow drawn on it. A first intermediate gear 4 is of stepped gear design and includes a ring gear 4*a* driven by the crankshaft gear 3 and a ring gear 4*b* engaging a camshaft gear 6 on a camshaft 7. The first intermediate gear 4 is supported by a recessed first bearing 5. This first bearing 5 is supported either directly by the crankcase 1 or by a gearbox connected thereto. In accordance with the arrows drawn on the intermediate gear 4 and the camshaft gear 6, the crankshaft 2 and the camshaft 7 in this exemplary embodiment rotate to the left (counterclockwise). A second recessed bearing 5*a* and a third recessed bearing 5*b* are also provided in the crankcase 1, or a gearbox, for mounting intermediate gears; however, these bearings 5*a,* 5*b* are not occupied in the exemplary embodiment of FIG. 1.

Figure 2:
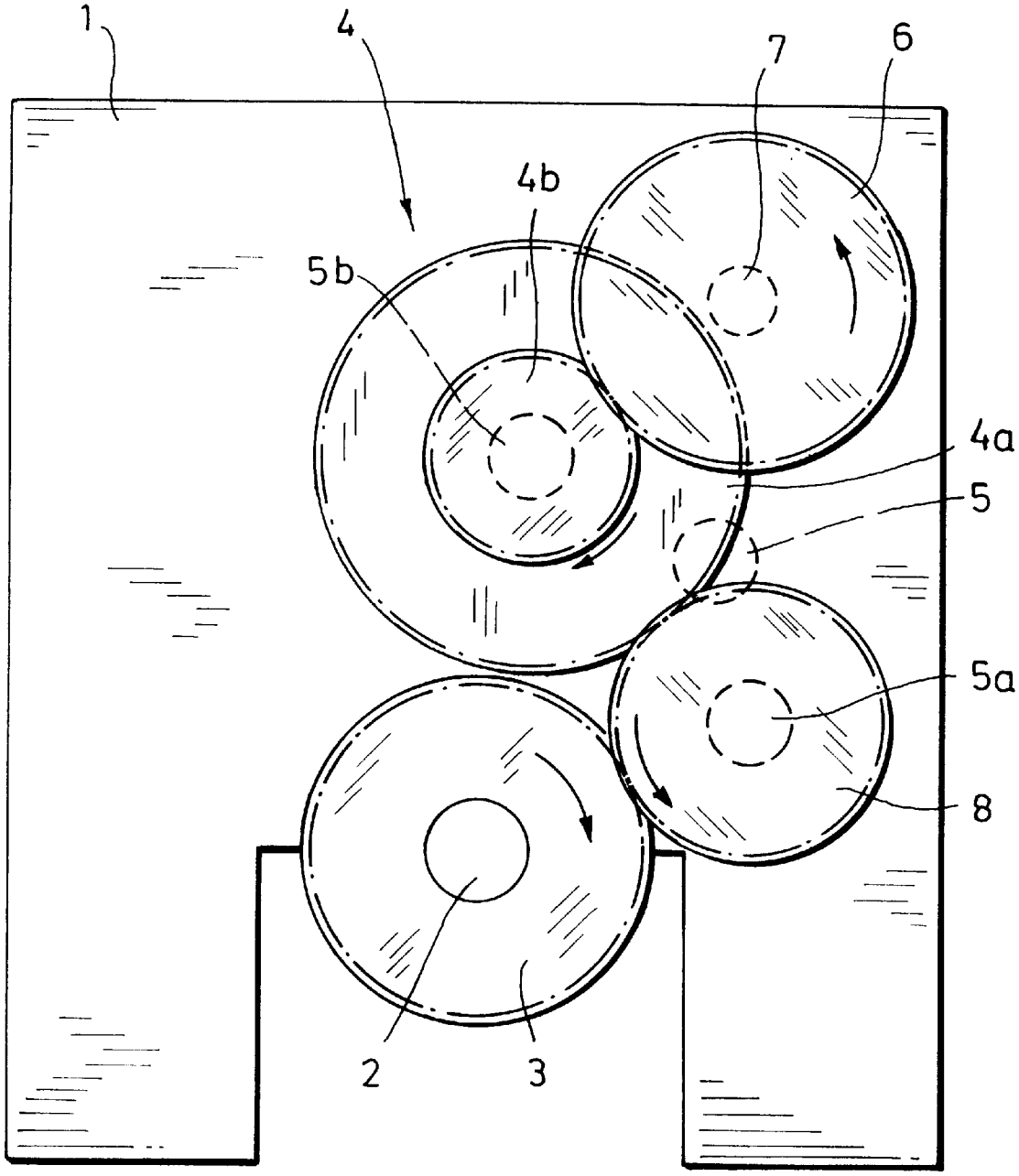
FIG. 2 shows a right-handed-rotating internal combustion engine of in-line design.

FIG. 2 shows the same crankcase as FIG. 1; however, the crankshaft 2 in this second embodiment rotates to the right (clockwise) in accordance with the arrow drawn on the crankshaft gear 3, while the camshaft 7 rotates to the left (counterclockwise), as in FIG. 1, in accordance with the arrow drawn on the camshaft gear 6. In this second embodiment the recessed bearing 5 is unoccupied, while the first intermediate gear 4 is supported by the recessed bearing 5*b* and has its ring gear 4*b* engaged with the camshaft gear 6. The ring gear 4*a* of intermediate gear 4 engages with the ring gear of a second intermediate gear 8, which is supported at the second recessed bearing 5*a* and has its ring gear simultaneously engaged with the crankshaft gear 3. The reversal of the rotation direction of the crankshaft 2 is effected by means of the insertion of this additional second intermediate gear 8.

Figure 3:
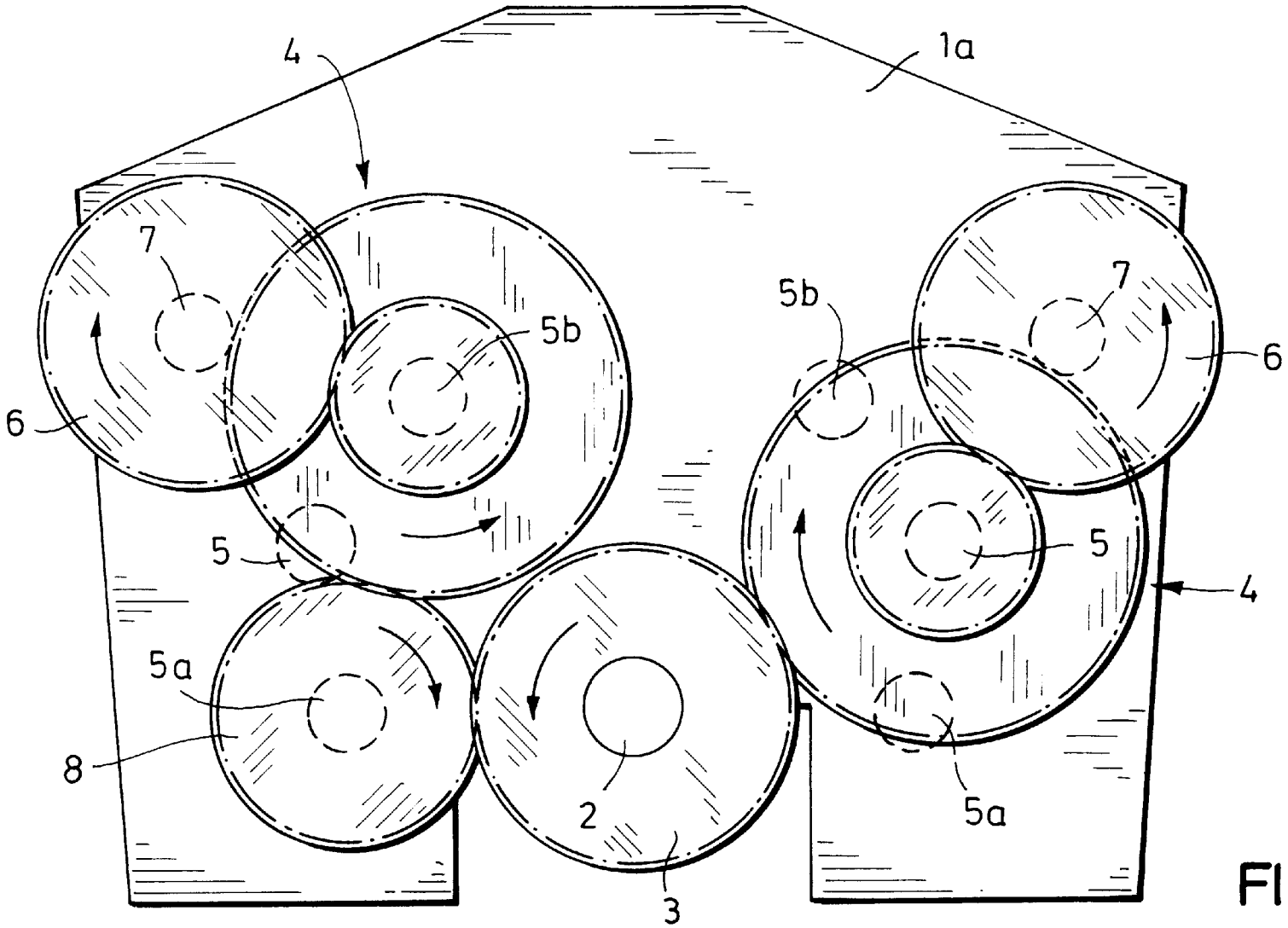
FIG. 3 shows a left-handed-rotating internal combustion engine of V design and FIG. 4 shows a right-handed-rotating internal combustion engine of V design.
Figure 4:
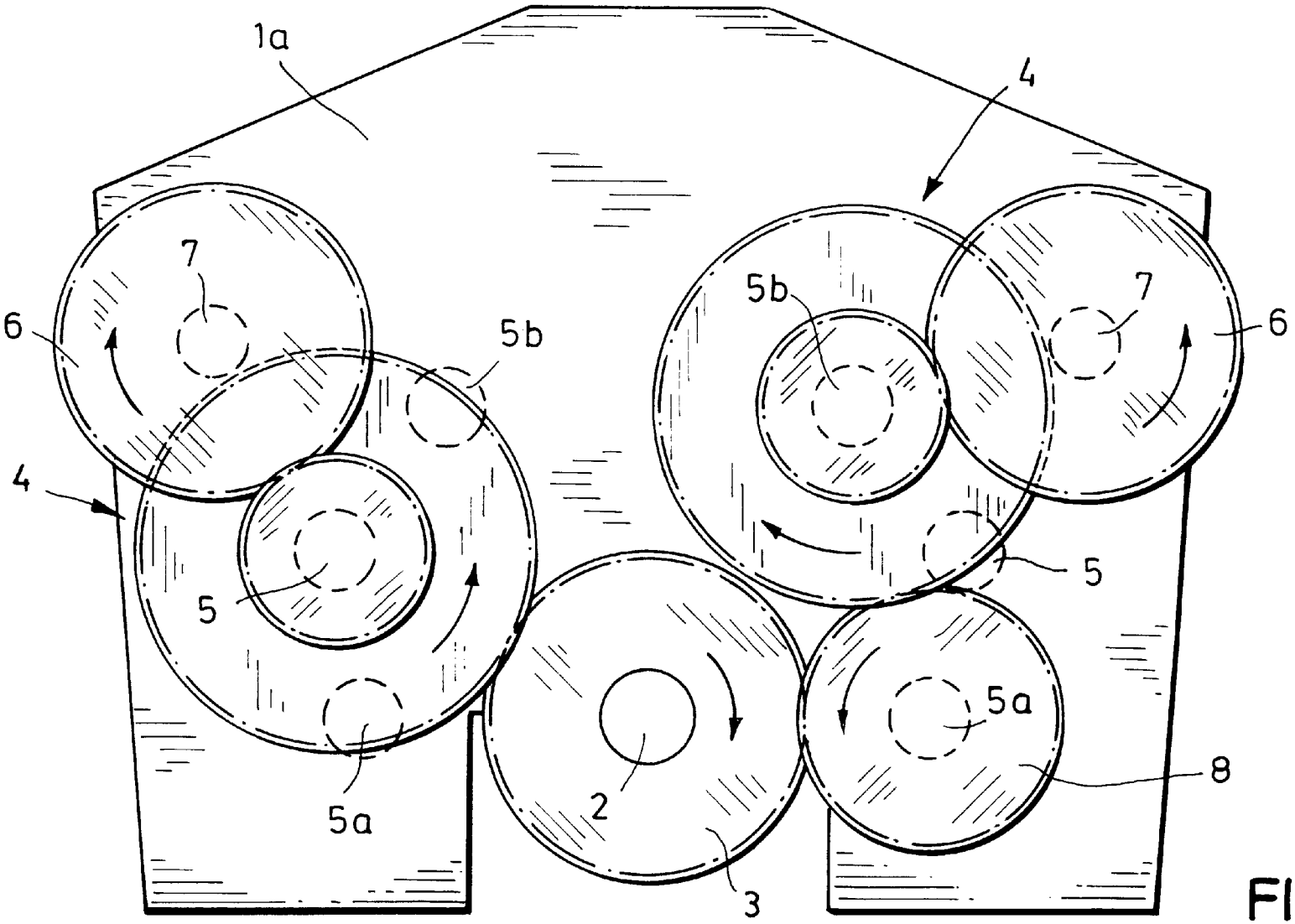

In the internal combustion engines of FIGS. 3 and 4, the crankcase 1*a*—again shown schematically—is of V design and, accordingly, includes two rows of cylinders disposed at a V angle. The respective breathing valves are driven via two camshafts 7, which are alike, bear the camshaft gears 6 on opposite shaft stubs. The camshafts 7 are thus counter-rotating, by virtue of appropriate gear drive trains from the crankshaft 2. For this purpose the intermediate gears 4 and 8, already explained in regard to FIGS. 1 and 2, are used, these again being inserted in the first recessed bearing 5, the second recessed bearing 5*a* and the third recessed bearing 5*b* according to the desired rotation direction of the camshafts 7. The following is the basic procedure for reversing the rotation direction of the left-handed-rotating internal combustion engine of FIG. 3 to the right-handed-rotating internal combustion engine of FIG. 4: The second intermediate gear 8 used on the left side of the internal combustion engine of FIG. 3 must be shifted to the right side of the internal combustion engine to the bearing 5*a,* the first intermediate gear 4 on the left side of the internal combustion engine must be shifted to the bearing 5 on the left side of the engine and the first intermediate gear 4 on the right side of the internal combustion engine must be shifted to the bearing 5*b* on the right side of the engine, as shown in FIG. 4.

In the various embodiments of the invention the axes of the crankshaft 2, camshaft 7, and bearings 5, 5*a* and 5*b* are parallel to one another.

What is claimed is:

1. In an internal combustion engine having a crankcase in which there is rotatably supported a crankshaft, to which there is articulated at least one connecting rod bearing a piston, and wherein a piston is movable in a cylinder covered by a cylinder head so as to form a working space, said working space being connected to breathing ducts via breathing valves and each breathing valve being actuated by a camshaft via a valve-actuating gearing, a construction for changing the direction of rotation of said combustion engine comprising:

a camshaft gear (6) on said camshaft (7);

a crankshaft gear (3) on said crankshaft (2);

first, second, and third recessed bearings (5, 5*a,* 5*b*) in said crankcase spaced from one another and disposed on parallel axes, said first recessed bearing (5) being adapted to support a first intermediate gear (4) having ring gears (4*a*) and (4*b*), meshing, respectively, with said crankshaft gear (3) and said camshaft gear (6) to thereby provide an engine rotating in one direction and said second and third recessed bearings (5*a*) and (5*b*) being adapted to support, respectively, a second intermediate gear (8) and said first intermediate gear (4) whereby said second intermediate gear (8) meshes with said crankshaft gear (3) and said ring gear (4*a*) of said first intermediate gear (4) and said ring gear (4*b*) meshes with said camshaft gear (6) to provide an engine rotating in a direction opposite to said one direction.

2. The internal combustion engine of claim 1 wherein the toothing of said gears is a step-up toothing.

3. The internal combustion engine of claim 1 wherein said internal combustion engine is an in-line engine.

4. The internal combustion engine according of claim 1 wherein said internal combustion engine is a V design engine with a pair of counter-rotating camshafts (7), and wherein a construction for changing the direction of rotation is provided between said crankshaft (2) and each of said camshafts.

* * * * *